US006520045B2

(12) United States Patent
Fukase et al.

(10) Patent No.: US 6,520,045 B2
(45) Date of Patent: Feb. 18, 2003

(54) VEHICLE PEDAL DEVICE ASSEMBLY INCLUDING TWO PEDALS WHOSE NON-OPERATED POSITIONS ARE ADJUSTABLE IN VEHICLE LONGITUDINAL DIRECTION

(75) Inventors: Akihiko Fukase, Aichi-ken (JP); Soshi Mitsuyama, Toyota (JP)

(73) Assignees: Toyoda Iron Works Co., Ltd., Toyota (JP); Toyota Jidosha Kabushiki Kaisha, Toyota (JP)

( * ) Notice: Subject to any disclaimer, the term of this patent is extended or adjusted under 35 U.S.C. 154(b) by 30 days.

(21) Appl. No.: 09/822,357

(22) Filed: Apr. 2, 2001

(65) Prior Publication Data

US 2001/0047696 A1 Dec. 6, 2001

(30) Foreign Application Priority Data

Apr. 4, 2000 (JP) ..... 2000-102233

(51) Int. Cl.[7] ..... G05G 1/14
(52) U.S. Cl. ..... 74/512; 180/334
(58) Field of Search ..... 74/512, 513, 560, 74/562, 478; 180/334, 320, 335

(56) References Cited

U.S. PATENT DOCUMENTS 3,086,406 A * 4/1963 Voser ..... 74/512
3,643,525 A 2/1972 Gibas
5,172,606 A 12/1992 Dzioba et al.
5,351,573 A * 10/1994 Cicotte ..... 74/512
5,927,154 A * 7/1999 Elton et al. ..... 74/512
6,019,015 A 2/2000 Elton
6,418,812 B2 * 7/2002 Mizuma et al. ..... 74/512
6,443,028 B1 * 9/2002 Brock ..... 74/512
6,453,767 B1 * 9/2002 Willemsen et al. ..... 74/512

FOREIGN PATENT DOCUMENTS

JP 52-44985 10/1977

* cited by examiner

*Primary Examiner*—David A. Bucci
*Assistant Examiner*—Colby Hansen
(74) *Attorney, Agent, or Firm*—Oblon, Spivak, McClelland, Maier & Neustadt, P.C.

(57) ABSTRACT

Vehicle pedal device assembly including a brake pedal device having brake pedal and adjusting mechanism operable to pivot adjusting link about support shaft and move the brake pedal through drive link in longitudinal direction of vehicle when the brake pedal is in non-operated state, and further including an accelerator pedal device having accelerator pedal, and pedal holding member which pivotally supports the accelerator pedal and which is disposed pivotally about mounting shaft, and wherein connecting link is provided to connect the pedal holding member and stationary member fixed to vehicle body, such that the pedal holding member and the accelerator pedal are moved in the longitudinal direction together with the brake pedal.

7 Claims, 6 Drawing Sheets

VEHICLE PEDAL DEVICE ASSEMBLY INCLUDING TWO PEDALS WHOSE NON-OPERATED POSITIONS ARE ADJUSTABLE IN VEHICLE LONGITUDINAL DIRECTION

This application is based on Japanese Patent Application No. 2000-102233 filed Apr. 4, 2000, the contents of which are incorporated hereinto by reference.

BACKGROUND OF THE INVENTION

1. Field of the Invention

The present invention relates to a pedal device for a vehicle, such as a brake pedal device and an accelerator pedal device, and more particularly to improvements of a vehicle pedal device assembly wherein the positions of operating portions of two or more pedals in their non-operated state are adjustable in the longitudinal or running direction of the vehicle.

2. Discussion of Related Art

JP-Y1-51-22218 discloses a pedal device for an automotive vehicle, which includes (a) a stationary bracket fixed on the body of the vehicle and having a support shaft and an adjusting shaft, (b) a pivotal arm disposed pivotally about the support shaft, to provide an output in the form of a pivotal motion thereof about the support shaft, (c) an adjusting link connected pivotally to the adjusting shaft, and pivotable by an adjusting mechanism about the adjusting shaft so that the adjusting link is positioned to a predetermined angular position, (d) a manually operable pedal connected to the adjusting link pivotally relative to the adjusting link about a first connecting shaft parallel to the support shaft, the pedal having an operating portion at which the pedal is operated by an operator of the vehicle, for a pivotal motion thereof about the first connecting shaft, and (e) a drive link connecting the pedal and the pivotal arm such that the drive link is pivotable about a second connecting shaft and a third connecting shaft which are disposed parallel to the support shaft, at respective positions which cooperate with the positions of the adjusting shaft and the first connecting shaft to define a rectangle, the drive link cooperating with the adjusting link to position the pedal with a predetermined attitude, the drive link being operable to pivot the pivotal arm about the support shaft when the pedal is pivoted about the first connecting shaft upon operation of the pedal at its operating portion, (f) and wherein the adjusting mechanism is operable to effect a pivotal motion of the adjusting link about the adjusting shaft, for thereby causing an arcuate motion of the pedal in a longitudinal direction of the vehicle together with a pivotal motion of the drive link about the third connecting shaft, so that the position of the operating portion of the pedal in its non-operated state is moved in the longitudinal direction. A single shaft may serve as the support shaft and the adjusting shaft. The pedal device constructed as described above permits an adjustment of the position of the operating portion of the pedal depending upon the specific physical characteristics of the vehicle operator, thereby facilitating the manipulation of the pedal by the operator.

The known vehicle pedal device described above is adapted to adjust the position of the operating portion of a single pedal such as a brake pedal or an accelerator pedal in the longitudinal direction of the vehicle. Where the vehicle has a plurality of pedals whose non-operated positions are adjustable as described above, two or more mutually independent mechanisms are required for the respective pedals, so that a pedal device assembly including the two or more pedals tends to be large-sized, requiring a relatively large space for installation on the vehicle and a relatively high cost of manufacture.

U.S. Pat. No. 3,643,525 discloses a vehicle pedal device assembly wherein two manually operable pedals are connected to respective two threaded shafts which are disposed to extend in the longitudinal direction of the vehicle and which are pivotable in synchronization with each other through a flexible cable, to concurrently adjust the positions of their operating portions in the longitudinal direction of the vehicle. While this pedal device assembly uses a single drive source, this pedal device assembly requires two sets of mechanisms for positional adjustment of the two pedals in the longitudinal direction, resulting in a relatively large size of the assembly. Further, it is practically difficult to thread the cable through the assembly upon installation of the assembly on the vehicle. Thus, the known vehicle pedal device assembly is not satisfactory. In addition, this pedal device assembly has a larger dimension in the longitudinal direction of the vehicle than the above-described pedal device disclosed in JP-Y1-51-22218, due to the two threaded shafts extending in the longitudinal direction. Accordingly, the pedal device assembly disclosed in the above-identified U.S. Patent is not desirable from the standpoint of the required installation space.

SUMMARY OF THE INVENTION

It is therefore an object of the present invention to provide a pedal device assembly for an automotive vehicle, which assembly is simple and compact in construction, economical to manufacture and capable of concurrent adjustments of the positions of the operating portions of a plurality of pedals in the longitudinal direction of the vehicle.

The above object may be achieved according to any one of the following modes of the present invention, each of which depends from the other mode or modes, where appropriate, to indicate and clarify possible combinations of elements or technical features.

(1) A pedal device assembly for a vehicle, comprising:

a stationary bracket fixed to a body of the vehicle and having a support shaft and an adjusting shaft;

a pivotal arm disposed pivotally about the support shaft, to provide an output in the form of a pivotal motion thereof about the support shaft;

an adjusting mechanism;

an adjusting link connected pivotally to the adjusting shaft, and pivotable by the adjusting mechanism so that the adjusting link is positioned to a predetermined angular position;

a manually operable first pedal connected to the adjusting link pivotally relative to the adjusting link about a first connecting shaft parallel to the support shaft, the first pedal having an operating portion at which the first pedal is operated by an operator of the vehicle, for a pivotal motion thereof about the first connecting shaft;

a drive link connecting the first pedal and the pivotal arm such that the drive link is pivotable about a second connecting shaft and a third connecting shaft which are disposed parallel to the support shaft, at respective positions which cooperate with positions of the adjusting shaft and the first connecting shaft to define a rectangle, the drive link cooperating with the adjusting link to position the first pedal with a predetermined attitude, and being operable to pivot the pivotal arm about the support shaft when the first pedal is pivoted about the first connecting shaft upon operation of the first pedal at the operating portion;

the adjusting mechanism being operable to effect a pivotal motion of the adjusting link about the adjusting shaft, for thereby causing an arcuate motion of the first pedal in a longitudinal direction of the vehicle together with a pivotal motion of the drive link about the third connecting shaft, so that a position of the operating portion in a non-operated state of the first pedal is moved in the longitudinal direction;

a pedal holding member pivotally supporting a second pedal and disposed pivotally about a mounting shaft provided on the adjusting link in parallel with the support shaft, the second pedal having an operating portion; and a connecting link connecting the pedal holding member and a stationary member fixed to the body of the vehicle, to position the pedal holding member with a predetermined attitude, the connecting link being pivotable about a fourth connecting shaft and a fifth connecting shaft which are disposed parallel to the support shaft, at respective positions which cooperate with the positions of the adjusting shaft and the mounting shaft to define a rectangle, the connecting link, and wherein the connecting link is pivoted about the fifth connecting shaft upon the pivotal motion of the adjusting link by the adjusting mechanism, and cooperates with the adjusting link to cause an arcuate motion of the pedal holding member in the longitudinal direction, so that a position of the operating portion of the second pedal in a non-operated state of the second pedal is moved in the longitudinal direction.

In the pedal device assembly constructed according to the above mode (1) of this invention, the pedal holding member for pivotally holding the second pedal is connected to an adjusting link provided in a pedal device as disclosed in JP-Y1-51-22218, and the connecting link is provided to connect the pedal holding device to a stationary member fixed to the vehicle body, such that a pivotal motion of the adjusting link about the adjusting shaft by the adjusting mechanism causes the pedal holding member and the second pedal to be moved along a circular arc in the longitudinal direction of the vehicle, in synchronization with the first pedal, so that the positions of the first and second pedals in their non-operated state are concurrently movable in the longitudinal direction so as to suit the particular physical characteristics of the vehicle operator.

In the present pedal device assembly, the adjustment of the non-operated positions of the first and second pedals can be made with a relatively simple and compact arrangement wherein the pedal holding member for the second pedal is associated with the adjusting link, and the pedal holding member and the stationary member are connected to each other through the connecting link. Accordingly, the required installation space and the cost of manufacture of the present pedal device assembly can be significantly reduced. Further, the present assembly permits concurrent and substantially identical movements of the first and second pedals, without connecting these two pedals through a cable.

In the present pedal device assembly, the first and second pedals may be selected from among various pedals used on a vehicle such as an automotive vehicle. For instance, the first and second pedal may be selected from among: a brake pedal for an ordinary braking system; a parking brake pedal for a parking brake system; an accelerator pedal for controlling a throttle valve or an actuator for the throttle valve; and a clutch pedal.

The pivotal arm may be connected to a suitable operating member such as: a rod of a brake booster; an accelerator cable; and a parking brake cable. The rod of the brake booster is pushed upon operation of the first or second pedal. On the other hand, the accelerator cable or parking brake cable is pulled upon operation of the pedal. Thus, an operating force or amount of the first or second pedal is mechanically transmitted to the operating member. However, the operating force or amount may be converted by a suitable detector into an electrical signal which is used to control a braking force or pressure to be generated by a braking system, or to control the throttle valve or throttle actuator indicated above. For instance, the detector may be a sensor for detecting an angle of rotation or torque of the pivotal arm.

The pedal device assembly may include a third pedal. In this case, the first, second and third pedals may be disposed such that the second pedal is disposed on one of the opposite sides of the first pedal, while the third pedal is disposed on the other side of the first pedal, in the same manner as the second pedal. Alternatively, the first pedal is disposed on one of the opposite sides of the second pedal, while a pedal device including the pivotal arm, adjusting link, drive link, third pedal and adjusting mechanism is disposed on the other side of the second pedal, in the same manner as the first pedal. In the latter case, a single shaft may serve as the support shaft and the adjusting shaft, for the three pedal devices, and a single shaft may serve as the first connecting shaft and the mounting shaft, for the three pedal devices, while a single adjusting mechanism may be used for the three pedal devices.

The adjusting mechanism for pivoting the adjusting link may be manually operated to pivot the adjusting link. Alternatively, the adjusting mechanism may include a power-operated drive source such as an electric motor, which is turned on with a suitable switch to automatically pivot the pivotal arm. The adjusting mechanism is supported by a stationary member fixed to the vehicle body, such as the stationary bracket, and is connected to the adjusting rink to pivot the adjusting link.

The expressions "pivotable about . . . shaft", "pivoted about . . . shaft", "pivotally about . . . shaft", and similar expressions used in the present application should be interpreted to mean a pivotal motion about an axis of the appropriate shaft, and does not necessarily mean a pivotal motion relative to the shaft per se.

(2) A pedal device assembly according to the above mode (1), wherein the first pedal is a brake pedal for operating an ordinary braking system of the vehicle, and the second pedal is an accelerator pedal for controlling a throttle valve of an engine of the vehicle.

In the pedal device assembly according to the above mode (2), the adjusting link pivotally supporting the brake pedal which receives a comparatively large operating force cooperates with the stationary bracket provide a comparatively high mechanical strength (a comparatively high degree of rigidity). On the other hand, the operating force acting on the accelerator pedal is comparatively small, so that the pedal holding member for pivotally holding the accelerator pedal may be disposed on the adjusting link, with a sufficiently high mechanical strength.

Of course, the first and second pedals may be any combination of pedals other than a combination of the brake pedal and the accelerator pedal.

(3) A pedal device assembly according to the above mode (1) or (2), wherein the support shaft also serves as the adjusting shaft, and the first connecting shaft also serves as the mounting shaft.

In the pedal device assembly according to the above mode (3) of the invention, the support shaft for pivotally supporting the pivotal arm also functions as the adjusting shaft for pivotally supporting the adjusting link, while the first connecting shaft for pivotally supporting the first pedal also functions as the mounting shaft to which the pedal holding member for the second pedal is pivotally connected. Accordingly, the present pedal device assembly can be made simpler and compact in construction than a pedal device assembly in which two separate shafts serve as the support shaft and the adjusting shafts, respectively, while two separate shafts serve as the first connecting shaft and the mounting shaft, respectively.

(4) A pedal device assembly according to the above mode (3), wherein the fourth and fifth connecting shafts are disposed substantially coaxially with the second and third connecting shafts, respectively; when the first pedal is in the non-operated state.

In the pedal device assembly according to the above mode (4) wherein the fourth and fifth connecting shafts to which the connecting link is pivotally connected are substantially coaxial with the second and third connecting shafts, respectively, while the first pedal is in the non-operated state, the pedal holding member for holding the second pedal is movable in the longitudinal direction of the vehicle, together with the first pedal, such that the vertical position and attitude of the second pedal are changed with a change in the position of the second pedal in its non-operated state in the longitudinal direction of the vehicle, in substantially the same manner as those of the first pedal. If the first and second pedals moved in the longitudinal direction had different attitudes or the positional relationship between these two pedals were changed during the movement in the longitudinal direction, the vehicle operator would feel uncomfortable with the performance of the pedal device assembly upon operation of the adjusting mechanism.

In the pedal device assembly according to the above modes (3) and (4), the support shaft also serves as the adjusting shaft while the first connecting shaft also serves as the mounting shaft. However, the adjusting shaft and the mounting shaft may be provided as shafts other than the support shaft and the first connecting shafts, respectively, and the axes of those adjusting and mounting shafts may be located at respective positions spaced apart from those of the support shaft and first connecting shaft. Although the assembly according to the above mode (4) has the support shaft also serving as the adjusting shaft, and the first connecting shaft also serving as the mounting shaft, the coaxial arrangement of the fourth and fifth connecting shafts with the respect to the second and third connecting shafts described above with respect to the above mode (4) may be employed even where the adjusting shaft and the support shafts are separate shafts.

While the fourth and fifth connecting shafts are substantially coaxial with the second and third connecting shafts while the first pedal is in the non-operated state, according to the above mode (4), this coaxial arrangement need not be employed in the pedal device assembly according to the above mode (3). Namely, the axes of the fourth and fifth connecting shafts may be radially offset from the axes of the second and third connecting shafts, even where the support shaft and the first connecting shaft also serve as the adjusting shaft and the mounting shaft, respectively.

(5) A pedal device assembly according to any one of the above modes (1)–(4) wherein the adjusting mechanism is operable to move the position of the operating portion of the first pedal in the non-operated state in the longitudinal direction such that the operating portion has a lowest vertical position when the operating portion is located at a fully retracted position nearest to a seat of the operator, and such that a vertical position of the operating portion is raised as the position of the operating portion is moved from the fully retracted position toward a fully advanced position in the longitudinal direction.

In the pedal device assembly according to the above mode (5) of this invention, the operating portion of the first pedal has the lowest vertical position when the operating portion of the first pedal in the non-operated state is at the fully retracted position nearest to the vehicle operator's seat. Further, the vertical position of the operating portion is gradually raised as the non-operated position of the operating portion is moved from the fully retracted position toward the fully advanced position. This arrangement permits adequate adjustment of the vertical position or height of the operating position so as to suit the physical characteristic of the operator, depending upon the non-operated position of the operating portion in the longitudinal direction of the vehicle. There is a general tendency that the operating portion of a pedal in its non-operated state is positioned comparatively near the operator's seat where the operator has relatively short legs and feet, and comparatively distant from the operator's seat where the operator has relatively long legs and feet. In view of this tendency, the vertical position of the operating portion of the first pedal is raised as the operating portion is moved from the fully retracted or rearmost position toward the fully advanced position, so that the first pedal can be relatively easily operated by any operator who is either tall or short.

Where the pedal device assembly according to the above mode (5) includes the feature according to the above mode (4), the vertical position of the operating portion of the second pedal is changed in the same manner as that of the operating portion of the first pedal, so that the second pedal can be further easily operated.

While the pedal device assembly according to the above mode (5) is adapted to raise the vertical position of the operating portion of the first pedal in its non-operated state, from the lowest position as the operating the operating portion is moved from the fully retracted position toward the fully advanced position, the operating portion may have the same vertical position or height at the fully retracted and advanced positions.

(6) A pedal device assembly according to any one of the above modes (1)–(5), wherein axes of the first and second connecting shafts are located below those of the adjusting shaft and the third connecting shaft, while the axes of the second and third connecting shafts are located rearwardly of those of the first connecting shaft and the adjusting shaft in the longitudinal direction, and wherein the adjusting shaft and the first, second and third connecting shafts are radially positioned relative to each other, so as to satisfy $L1 \geqq L3$, and $L2 > L4$, or satisfy $L1 < L3$, and $L2 \geqq L4$, wherein the L1, L2, L3 and L4 respectively represent a distance between the axes of the adjusting shaft and the first connecting shaft, a distance between the axes of the first and second connecting shafts, a distance between the axes of the second and third connecting shafts, and a distance between the axes of the third connecting shaft and the adjusting shaft.

In the pedal device assembly according to the above mode (6), the axes of the first and second connecting shafts are located below those of the adjusting shaft and the third connecting shaft, while the axes of the second and third connecting shafts are located rearwardly of those of the first connecting shaft and the adjusting shaft in the longitudinal direction, and the adjusting shaft and the first, second and third connecting shafts are radially positioned relative to each other, so as to satisfy L1≧L3, and L2>L4, or satisfy L1<L3, and L2≧L4. In this arrangement, the attitude of the first pedal is changed such that the operating surface of the operating portion of the first pedal is gradually inclined upwards as the operating portion is moved toward the fully retracted position at which the operating surface faces most upwards. As the position of the operating portion is moved toward the fully advanced position, the operating surface is gradually inclined sidewards. Thus, the angle of the operating surface with respect to the vertical plane is adjusted as the non-operated position of the operating portion is moved in the longitudinal direction of the vehicle, so as to meet the physical characteristics of the operator, so that the first pedal can be further easily operated. When the operating portion of the pedal in the non-operated state is located at the fully retracted position nearest to the operator's seat, the foot of the operator tends to approach the operating surface in a relatively downward direction. In view of this tendency, the operating surface is oriented to face most upwards at the fully retracted position of the operating portion, and the operating surface is gradually inclined sidewards as the position of the operating portion is moved toward the fully advanced position. This arrangement permits relatively easy manipulation of the first pedal by any operator who is either tall or short.

Where the pedal device assembly according to the above mode (6) includes the feature according to the above mode (4), the attitude of the operating portion of the second pedal is changed in the same manner as that of the first pedal, so that the second pedal can be easily operated.

Although the pedal device assembly according to the above mode (6) is adapted to change the attitude of the first pedal such that the operating surface of the operating portion is gradually inclined upwards as the non-operated position of the operating portion is moved toward the fully retracted position, this arrangement is not essential. For instance, the operating portion of the first pedal may be translated along a circular arc in the longitudinal direction of the vehicle, without changing its posture. Alternatively, the attitude of the first pedal may be changed such that the operating surface of the operating portion is gradually inclined upwards as the non-operated position of the operating portion is moved from the fully retracted position toward the fully advanced position.

By determining the distances L1—L4 so as to satisfy L1=L3, and L2=L4, the operating portion of the first pedal can be translated without changing its posture as the non-operated position of the operating portion is moved between the fully advanced and retracted positions in the longitudinal direction of the vehicle. In this case, the operating portion of the first pedal has the lowest vertical position when the operating portion is located at the fully retracted position, where the adjusting mechanism is arranged such that the first connecting shaft is located right under the adjusting shaft when the operating portion is at the fully retracted position. The operating portion has the lowest vertical position at the fully retracted position, provided the first connecting shaft is located right under the adjusting shaft or on the front side of the adjusting shaft as viewed in the longitudinal direction of the vehicle, when the operating portion is located at the fully retracted position. The position of the drive link may be located on the front side of the adjusting shaft and the first connecting shaft as viewed in the longitudinal direction of the vehicle.

Although the drive link is located rearwardly of the adjusting shaft and the first connecting shaft in the longitudinal direction of the vehicle in the assembly according to the above mode (6), the drive link may be located on the front side of the adjusting shaft and the first connecting shaft, in the pedal device assembly according to any one of the above modes (1)–(5). In this case, lengths of the four sides of the rectangle defined by the adjusting shaft and the first, second and third connecting shafts may be suitably determined. For instance, L21–L24 may be determined so as to, so as to satisfy L21≧L23, and L22>L24, or satisfy L21<L23, and L22≧L24, wherein the L21, L22, L23 and L24 respectively represent a distance between the axes of the second and third connecting shafts (the length of the front side of the rectangle), a distance between the axes of the first and second connecting shafts (the length of the lower side of the rectangle), a distance between the axes of the first connecting shaft and the adjusting shaft (the length of the rear side of the rectangle), and a distance between the axes of the third connecting shaft and the adjusting shaft (the length of the upper side of the rectangle). This arrangement provides the same advantages as the arrangement according to the above mode (6).

Although the axes of the first and second connecting shafts are located below those of the adjusting shaft and the third connecting shaft in the above mode (6) of the invention, the axes of the first and second connecting shafts may be located above those of the adjusting shaft and the third connecting shaft, so as to define a rectangle of a rectangular link mechanism provided by the pivotal arm, adjusting link, first pedal and drive link.

BRIEF DESCRIPTION OF THE INVENTION

The above and other objects, features, advantages and technical and industrial significance of the present invention will be better understood by reading the following detailed description of presently preferred embodiments of the invention, when considered in connection with the accompanying drawings, in which.

Figure 1B:
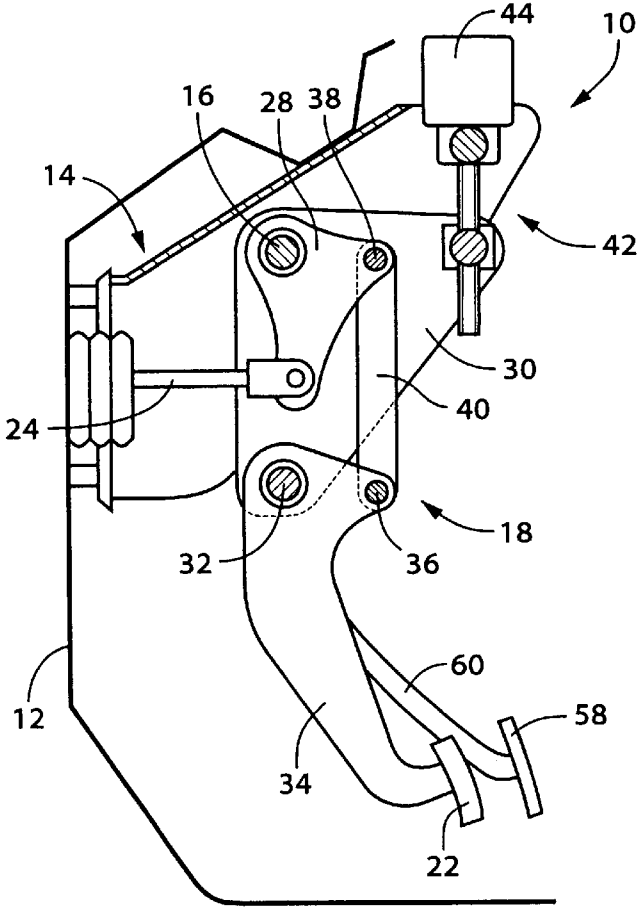
FIGS. 1A and 1B are partly cut-away front elevational views of a vehicle pedal device assembly according to a first embodiment of this invention, FIG. 1A showing the operating portions of a brake pedal and an accelerator pedal when the operating portions are located at their fully advanced positions, while FIG. 1B showing the operating portions located at their fully retracted positions.
Figure 1A:
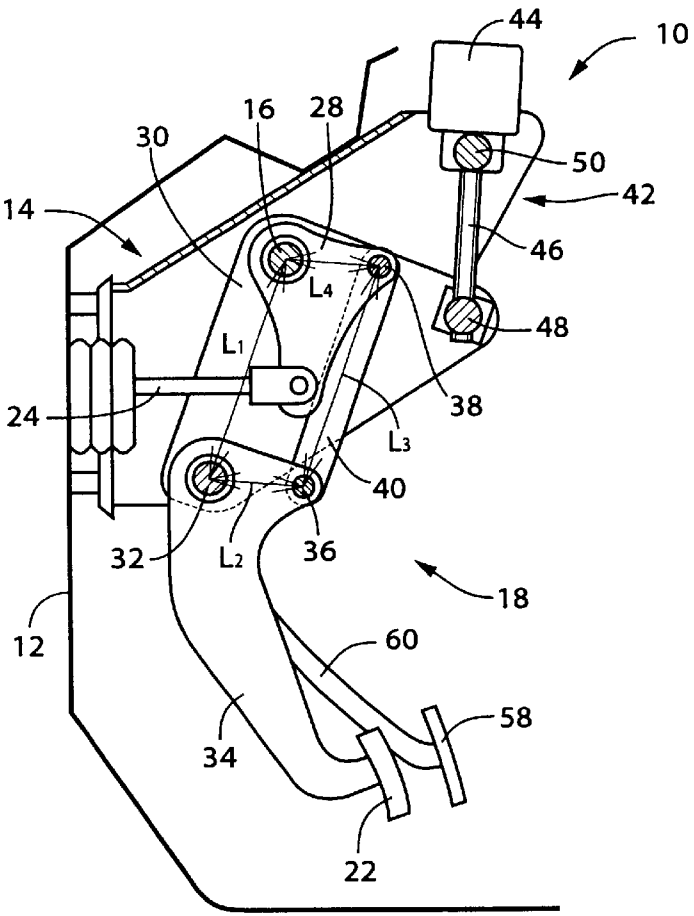
Figure 5:
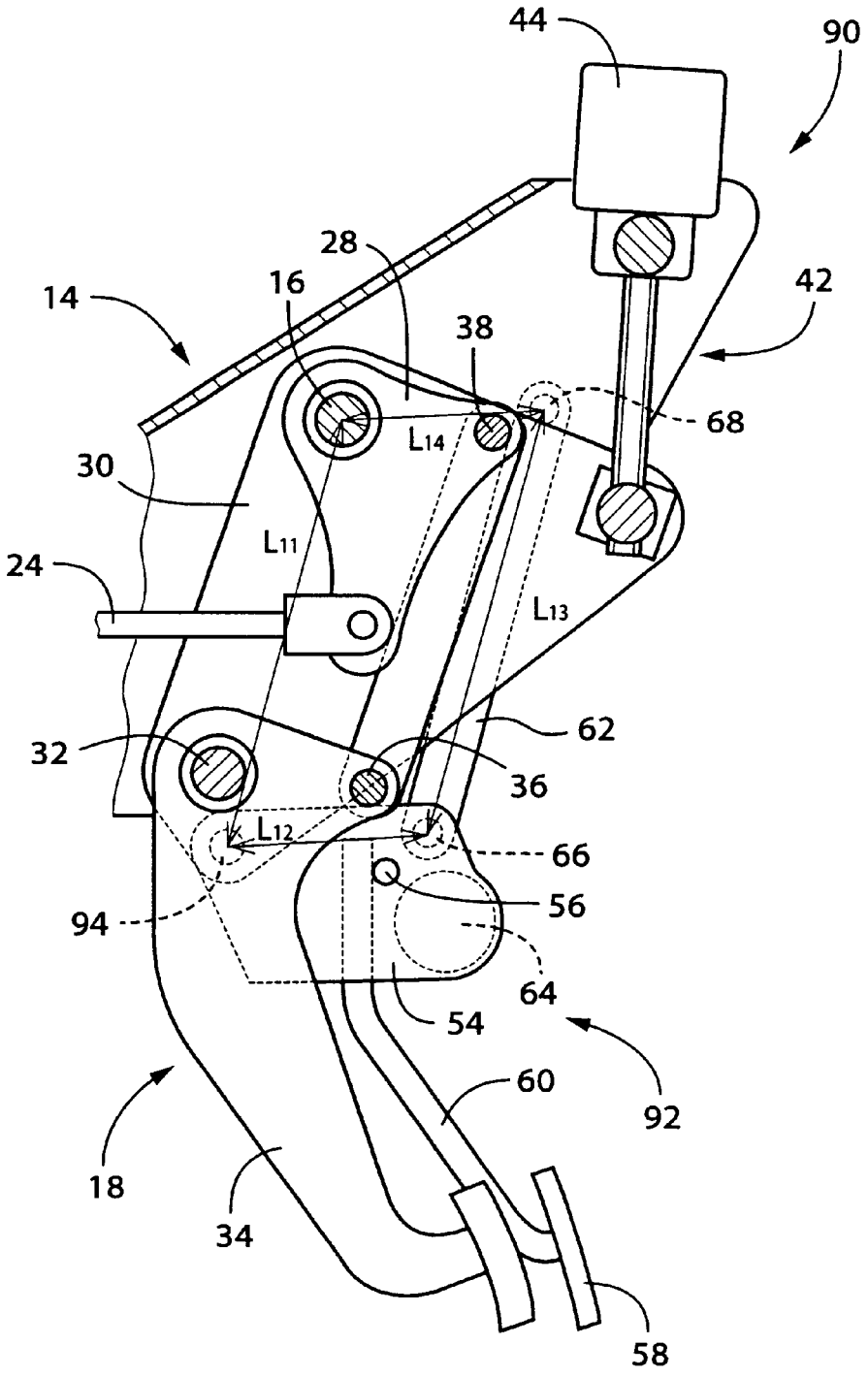
Figure 6:
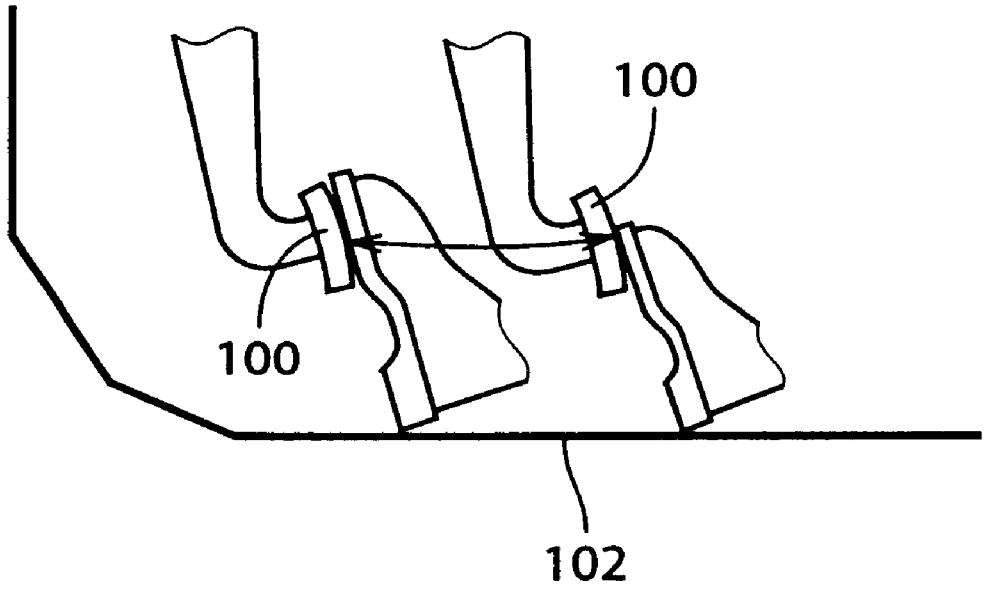

FIG. 5 is a view corresponding to that of FIG. 1A, showing a fourth embodiment of the invention; and FIG. 6 is a view showing an example of a known vehicle pedal device wherein the vertical position of the operating portion of a pedal when the operating portion is located at its fully advanced position is substantially the same as that when the operating portion is located at its fully retracted position.

DETAILED DESCRIPTION OF THE PREFERRED EMBODIMENTS

Figure 2:
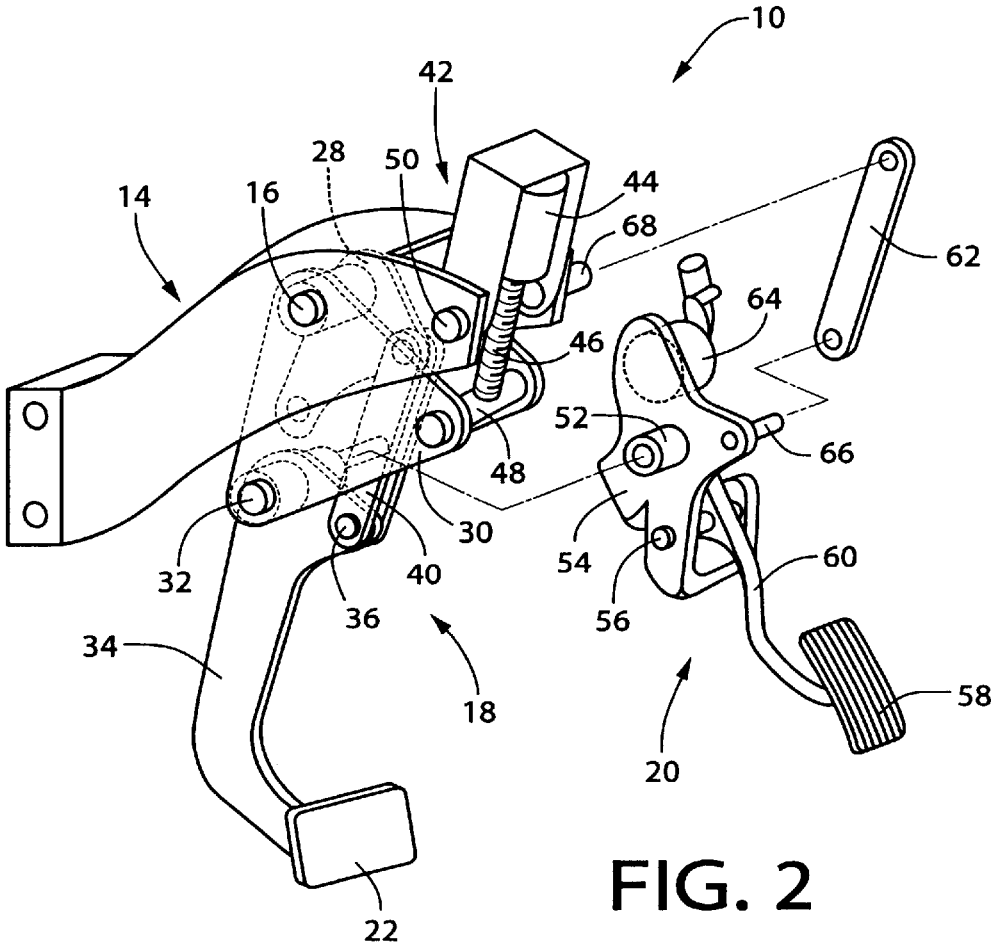
FIG. 2 is an exploded perspective view showing a portion of the pedal device assembly of FIG. 1.

Referring to the partly cut-away front elevational views of FIGS. 1A, 1B and the fragmentary exploded perspective view of FIG. 2, there is shown a pedal device assembly 10 as installed on an automotive vehicle, which assembly 10 is constructed according to a first embodiment of the present invention. The left-hand side and the right-hand side in the views of FIGS. 1A and 1B correspond to the front and rear sides of the vehicle, respectively. The pedal device assembly 10 is located in front of a seat for the vehicle operator. A portion of the pedal device assembly 10 is shown in the exploded perspective view of FIG. 2. The pedal device assembly 10 includes a brake pedal device 18 for operating an ordinary braking system of the vehicle, and an accelerator pedal device 20 connected to and cooperating with the brake pedal device 18 so as to form the assembly 10. The brake pedal device 18 is connected to a support shaft 16 disposed on a stationary bracket 18 fixed on the body of the vehicle.

The brake pedal device 18 includes a manually operable brake pedal 34 having an operating portion 22 at its lower end, and a pivotal arm 28 disposed pivotally about the support shaft 16. The pivotal arm 28 is connected through a clevis to a rod 24 of a brake booster of the braking system. When the brake pedal 34 is operated by the vehicle operator at its operating portion 22, the pivotal arm. 28 is pivoted about the support shaft 16 in the clockwise direction from the original position of FIGS. 1A and 1B, and pushes the booster rod 24, so that a push rod of a master cylinder of the braking system, whereby the master cylinder generates a hydraulic pressure. In the present embodiment, the booster rod 24 functions as an operating member which activates the master cylinder. The support shaft 16 is attached to the stationary bracket 14 such that the axis of the support shaft 16 is substantially parallel to the transverse or lateral direction of the vehicle.

In the brake pedal device 18, the position of the operating portion 22 of the brake pedal 34 in its non-operated state is adjustable or movable between a fully advanced position of FIG. 1A (on the front side of the vehicle) and a fully retracted position of FIG. 1B (on the rear side of the vehicle). The brake pedal device 18 includes: (i) the above-indicated pivotal arm 28 disposed pivotally about the support shaft 16 and connected to the booster rod 24, (ii) an adjusting link 30 connected at its upper end portion to the support shaft 16 pivotally relative to the pivotal arm 28; (iii) the brake pedal 34 having the above-indicated operating portion 22 and connected to a lower end portion of the: adjusting link 30 pivotally relative to the adjusting link 30 about a first connecting shaft 32 parallel to the support shaft 16; and (iv) a drive link 40 connected at its lower portion to the brake pedal 34 pivotally relative to the brake pedal 34 about a second connecting shaft 36 parallel to the support shaft 16 and located rearwardly of the first connecting shaft 32 as viewed in the longitudinal direction of the vehicle, and at its upper end portion to the pivotal arm 28 pivotally relative to the pivotal arm 28 about a third connecting shaft 38 parallel to and located rearwardly of the support shaft 16. As is apparent from FIG. 2, each of the adjusting link 30 and the drive link 40 consists of two plates. The brake pedal 34 serves as a first pedal provided in the pedal device assembly 10. In the present embodiment, the adjusting link 30 as well as the pivotal link 28 is pivotally connected to the support shaft 16. However, the adjusting link 30 may be pivotally connected to an exclusive adjusting shaft which is disposed apart from the support shaft 16 to which only the pivotal arm is connected.

While the brake pedal 34 is in the non-operated state or placed in its non-operated position, the pivotal arm 28 is held in the predetermined original or non-operated position of FIGS. 1A and 1B while being biased pivotally about the support shaft 16 in the counterclockwise direction by the booster rod 24. When the brake pedal 34 is operated at its operating portion 22, the pivotal arm 28 is pivoted about the support shaft 16 in the clockwise direction, so as to push the booster rod 24. Thus, the pivotal arm 28 is placed in the original position when the brake pedal device 18 and the brake pedal 34 are in the non-operated state or position. The original position of the pivotal arm 28 may be determined by a distance of extension of the booster rod 24 from the brake booster, or by abutting contact with a stop disposed on the bracket 14.

The pedal device assembly 10 includes an adjusting mechanism 42 operable to pivot the adjusting link 30 about the support shaft 16, for establishing a desired angular position of the adjusting link 30. The adjusting mechanism 42 includes a drive source in the form of an electric motor 44, an externally threaded shaft 46 rotatable by the electric motor 44, and an internally threaded member 48 which engages the externally threaded shaft 46. The internally threaded member 48 takes the form of a shaft which has a tapped hole and which is supported by the adjusting link 30 such that the shaft 48 is rotatable about an axis parallel to the support shaft 16. When the externally threaded shaft 46 is rotated by the electric motor 44, the internally threaded member 48 is moved in the axial direction of the externally threaded member 46, so that the adjusting link 30 is pivoted about the support shaft 16. The thread of the externally threaded shaft 46 has a lead or pitch small enough to prevent a rotary movement of the externally threaded member 46 and a consequent axial movement of the member 46 relative to the internally threaded member 48 even when an axial load acts between the externally and internally threaded members 46, 48 upon operation of the brake pedal 34. Accordingly, once the desired angular position of the adjusting link 30 is established by operation of the electric motor 44, the adjusting link 30 is held in the established angular position with the electric motor 44 held in the off state.

The drive link 40 cooperates with the adjusting link 30 to position the brake pedal 34 with a predetermined attitude. Described more specifically, when the adjusting link 30 is pivoted about the support shaft 16 by the adjusting mechanism 42 while the brake pedal 34 is in the non-operated state, the drive link 40 is pivoted about the third connecting shaft 38, and the brake pedal 34 is given an arcuate movement in the longitudinal direction of the vehicle so that the operating portion 22 is moved to a desired position corresponding to the amount of operation of the electric motor 44, between the fully advanced and retracted positions of FIGS. 1A and 1B, in the longitudinal direction of the vehicle. In the present embodiment, the support shaft 26 and the first, second and third connecting shafts 32, 36, 38 are radially positioned relative to each other so as to satisfy the following equations (1) and (2):

$$L1=L3 \quad (1)$$

$$L2=L4 \quad (2)$$

In the above equations (1) and (2), L1–L4 represent the following distances:

- L1=distance between the axes of the support shaft 16 and the first connecting shaft 32
- L2=distance between the first and second connecting shafts 32,
- L3=distance between the second and third connecting shafts 36,
- L4=distance between the third connecting shaft 38 and the support shaft 16

The positioning of the shafts 16, 32, 36, 38 as described above permits the brake pedal 34 with the operating portion 22 to be translated along a circular arc in the longitudinal direction of the vehicle, without a change in the attitude of the brake pedal 34 (of the operating portion 22). It will be understood that the pivotal arm 28, adjusting link 30, brake pedal 34 and drive link 40 are operatively connected to form a rectangular link mechanism, more precisely, a parallelogrammic link mechanism. This link mechanism permits a pivotal motion of the brake pedal 34 relative to the pivotal arm 28 which is held stationary with its attitude kept constant.

The fully advanced and retracted positions of the operating portion 22 are determined such that the fully retracted position of FIG. 1B is established when the axis of the first connecting shaft 32 is located right under the axis of the support shaft 16, as indicated in FIG. 1B. In this arrangement, the operating portion 22 has the lowest vertical position when it is located at the fully retracted position nearest to the operator's seat. The vertical position of the operating portion 22 is gradually raised as the operating portion 22 is moved from the fully retracted position toward the fully advanced position.

When the brake pedal 34 is operated at its operating portion 22 after its non-operated position is adjusted through the adjusting link 30 in the longitudinal direction of the vehicle by the adjusting mechanism 42, the brake pedal 34 is pivoted clockwise about the first connecting shaft 32, and the pivotal arm 28 is pivoted clockwise about the support shaft 16 through the drive link 40, so that the booster rod 24 is pushed by the pivotal arm 28 to activate the master cylinder, for thereby producing a braking force for braking the vehicle.

As shown in FIG. 2, the accelerator pedal device 20 includes: (i) a pedal holding member 54 attached through a sleeve 52 to the first connecting shaft 32 such that the pedal holding member 54 is pivotable about the first connecting shaft 32; (ii) a manually operable accelerator pedal 60 having an operating portion 58 at its lower end and supported by the pedal holding member 54 such that the accelerator pedal 60 is pivotable about a mounting shaft 56 parallel to the first connecting shaft 32; and (iii) a connecting link 62 connecting the pedal holding member 54 and the stationary bracket 14. The first connecting shaft 32, which extends through the pair of plates of the adjusting link 30, has a right end portion exposed on the right side of the adjusting link 30 as viewed in FIG. 1B. The sleeve 52 engages this right end portion of the first connecting shaft 32 through a bearing such that the sleeve 52 is rotatable relative to the first connecting shaft 32. However, the pedal holding member 54 may be pivotally connected to the first connecting shaft 32, at a position between the two plates of the adjusting link. In this case, the two plates have a comparatively large distance therebetween. In the present embodiment, the first connecting shaft 32 also serves as a shaft for pivotally holding the pedal holding member 54.

The accelerator pedal 60 is held in its non-operated position by a suitable stop or under a biasing force of a return spring. When the accelerator pedal 60 is operated at its operating portion 58, the accelerator pedal 60 is pivoted about the mounting shaft 56, and the angular position of the accelerator pedal 60 with respect to its non-operated position is electrically detected by an angular position sensor 64. Namely, the output signal of this sensor 64 which represents the operating amount or angle of the accelerator pedal 60 is used to control a throttle actuator for operating a throttle valve of an engine of the vehicle. The accelerator pedal serves as a second pedal provided in the pedal device assembly 10, in addition to the first pedal in the form of the brake pedal 34

The connecting link 62 is connected at its one end to a fourth connecting shaft 66 disposed on the pedal holding member 54 such that the fourth connecting shaft 66 is parallel with the sleeve 52, that is, parallel to the support shaft 16 when the pedal holding member 54 is connected to the first connecting shaft 32. The connecting link 62 is disposed pivotally about the fourth connecting shaft 66. The connecting link 62 is connected at the other end to a fifth connecting shaft 68 disposed on the stationary bracket 14 such that the shaft 68 is parallel to the support 16. The fourth and fifth connecting shafts 66, 68 are positioned relative to the pedal holding member 54 and the bracket 14, respectively, such that these fourth and fifth connecting shafts 66, 68 are substantially coaxial with the second and third connecting shafts 36, 38, respectively, while the brake pedal 34 is placed in its non-operated state. The axes of the fourth and fifth connecting shafts 66, 68 cooperate with the support shaft 16 and the first connecting shaft 32 to define a rectangle, more precisely, a parallelogram, in a plane perpendicular to the axes. It will be understood that the pivotal arm 28, adjusting link 30, pedal holding member 54 and connecting link 62 cooperate to form a rectangular link mechanism, more precisely, a parallelogrammic link mechanism. The bracket 14 may be considered as a stationary member fixed to the vehicle body, or as a part of the vehicle body.

In the presence of the connecting link 62, the pedal holding member 54 is held at a position corresponding to the position of the adjusting link 30. When the accelerator pedal 60 is operated at its operating portion 58, the accelerator pedal 60 is pivoted about the mounting shaft 56, and the amount or angle of operation of the accelerator pedal 60 is detected by the angular position sensor 64. When the adjusting link 30 of the brake pedal device 18 is pivoted about the support shaft 16 by the adjusting mechanism 42 while the brake pedal 34 and the accelerator pedal 60 are placed in their non-operated state, the pedal holding member 54 is also pivoted about the support shaft 16 by a movement of the axis of the first connecting shaft 32, while at the same time the connecting link 62 is pivoted about the fifth connecting shaft 68, so that the pedal holding member 54 is translated along a circular arc in the longitudinal direction of the vehicle. Since the fourth and fifth connecting shafts 66, 68 are substantially coaxial with the respective second and third connecting shafts 36, 38 in the non-operated state of the brake pedal 34, the pedal holding member 54 is translated along the circular arc, without a change in the attitude of the pedal holding member 54, like the brake pedal 34, so that the position of the accelerator pedal 60 is moved or adjusted in the longitudinal direction of the vehicle.

In the vehicle pedal device assembly 10 according to the present embodiment of the invention, the pedal holding member 54 of the accelerator pedal device 20 is pivotally connected to the first connecting shaft 32 to which the brake pedal 34 is pivotally connected, and the pedal holding member 54 and the bracket 14 are connected by the connecting link 62, so that a pivotal motion of the adjusting link 30 of the brake pedal device 18 about the support shaft 16 by the adjusting mechanism 42 will cause not only a movement of the brake pedal 34 but also a movement of the pedal holding member 54, along respective circular arcs, in the longitudinal direction of the vehicle. Accordingly, the non-operated positions of the brake pedal 34 of the brake pedal device 18 and the accelerator pedal 60 of the accelerator pedal device 10 can be adjusted or moved in the longitudinal direction of the vehicle, depending upon the particular physical characteristics of the vehicle operator.

It is noted that the brake pedal device 18 and the accelerator pedal device 20 are interconnected to each other with a simple mechanism including the pedal holding member 54 pivotally connected to the first connecting shaft 32, and the connecting link 62 connecting the pedal holding member 54 and the bracket 14. Thus, the pedal device assembly 10 is made relatively simple and compact in construction, requiring a relatively small installation space, and is available at a relatively low cost. It is noted in particular that the support shaft 16 to which the pivotal arm 28 is pivotally connected also serves as an adjusting shaft for pivotally supporting the adjusting link 30, while the first connecting shaft 32 to which the brake pedal 34 is pivotally connected also serves as a mounting shaft for pivotally supporting the pedal holding member 54. In this respect, the pedal device assembly 10 can be made simpler and more compact than an assembly which uses exclusive adjusting shaft and mounting shaft for pivotally supporting the adjusting link 30 and the pedal holding member 54.

The brake pedal 34 and the accelerator pedal 60 are interconnected to each other for substantially identical concurrent movements within the same assembly 10, without using a cable connecting the two pedals 34, 60.

It is further noted that the adjusting link 30 pivotally supporting the brake pedal 34 which receives a comparatively large operating force cooperates with the stationary bracket 14 to provide a comparatively high mechanical strength (a comparatively high degree of rigidity), while the right end portion of the first connecting shaft 32 provides a mechanical strength high enough to support the pedal holding member 54 of the accelerator pedal device 20, which pivotally support the accelerator pedal 60 which receives a comparatively small operating force. In the present arrangement wherein the sleeve 52 of the pedal holding member 52 engages the right end portion of the first connecting shaft 32, which end portion extends from the right-hand side plate of the adjusting link 30, the dimensions of the stationary bracket 14 and the adjusting link 30 in the axial direction of the shaft 32 can be made considerably smaller, than in an arrangement wherein the pedal holding member 54 is pivotally connected to a portion of the shaft 32 between the two plates of the adjusting link 30, which two plates are spaced apart from each other by a relatively large distance. Thus, the present pedal device assembly 10 is made further compact.

It is also noted that the fourth and fifth connecting shafts 66, 68 to which the connecting link 62 is connected are disposed substantially coaxially with the second and third connecting shafts 36, 38, respectively, so that the pedal holding member 54 can be moved together with the brake pedal 34 in the longitudinal direction of the vehicle. This arrangement assures the accelerator pedal 60 to be translated in the longitudinal direction of the vehicle, in substantially the same manner as the brake pedal 34, in terms of a change in the vertical position of the pedals 60, 34 and the permanency of the attitude of the operating portions 58, 22. If the translated pedals 34, 60 had different attitudes or the positional relationship between these two pedals 34, 60 were changed during the translation, the vehicle operator would feel uncomfortable with the performance of the assembly 10 upon operation of the adjusting mechanism 42.

The pedal device assembly 10 is further arranged such that the operating portion 22 of the brake pedal 34 in its non-operated state has the lowest position when the operating portion 22 is located at the fully retracted position nearest to the operator's seat, and such that the vertical position of the operating portion 22 is raised as the operating portion 22 is moved toward the fully advanced position. Thus, the height of the operating portion 22 of the brake pedal 34 in the non-operated state is adequately adjusted depending upon the position of the operating portion 22 in the longitudinal direction of the vehicle, which is adjusted so as to meet the physical characteristics of the vehicle operator, in particular, the length of the operator's legs, for facilitating the manipulation of the brake pedal 34. There is a general tendency that the operating portion 22 of the brake pedal 34 in its non-operated state is positioned comparatively near the operator's seat where the operator has relatively short legs and feet, and comparatively distant from the operator's seat where the operator has relatively long legs and feet. In view of this tendency, the vertical position of the operating portion 22 is raised as the operating portion is moved from the fully retracted or rearmost position toward the fully advanced position, so that the brake pedal 34 can be relatively easily operated by any operator who is either tall or short.

The known pedal device disclosed in the publication JP-Y1-51-22218 referred to above is adapted such that the vertical position of an operating portion 100 is held substantially constant at any position in the longitudinal direction of the vehicle, within a range in which the operating portion 10 is movable, as indicated in FIG. 6. If the vertical position of the operating portion 100 at the fully advanced position is determined to suit an operator having relatively long legs, this vertical position which remains the same at the fully retracted position is higher than the optimum position for an operator having relatively short legs. If the vertical position of the operating portion 100 is determined to suit the operator having the relatively short legs, on the other hand, the vertical position is lower than the optimum position for the operator having the relatively long legs. Thus, the known pedal device of FIG. 6 is not satisfactory, since the operating portion 100 in the non-operated state has substantially the same height at the fully advance and retracted positions. In FIG. 6, reference numeral 106 denotes a floor of the vehicle.

Since the vertical position or height of the operating portion 58 of the accelerator pedal 60 is changed in the same manner as that of the operating portion 22 of the brake pedal 34, the accelerator pedal 60 can also be operated with ease, like the brake pedal 34.

Figure 3:
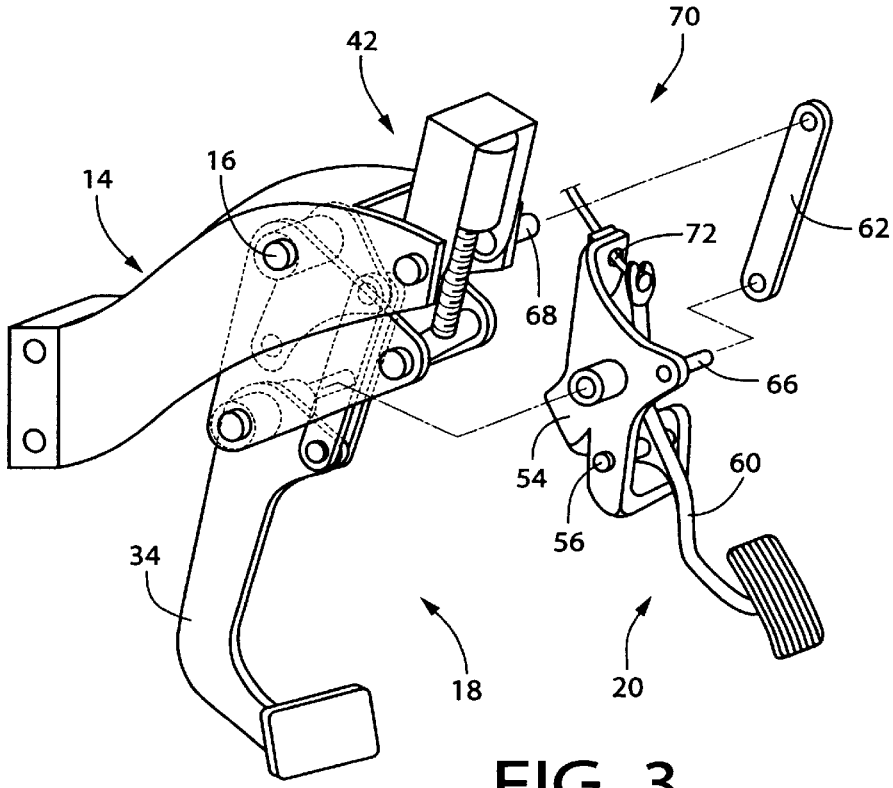
FIG. 3 is a view corresponding to that of FIG. 1, showing a pedal device assembly according to a second embodiment of the invention, wherein a movement of the accelerator pedal is transmitted through an accelerator cable.

Referring to FIGS. 3–5, there will be described other embodiments of this invention. The same reference signs as used in the first embodiment will be used in these other embodiments to identify the functionally corresponding elements, and redundant description of these elements will not be provided.

In a vehicle pedal device assembly 70 constructed according to a second embodiment of this invention shown in FIG. 3, an accelerator cable 72 is used in place of the angular position sensor 64 provided on the pedal holding member 54 to detect the operating angle of the accelerator pedal 60 in the pedal device assembly 10. The accelerator cable 72 is connected at its one end to the upper end of the accelerator pedal 60, and at the other end to a throttle valve of the vehicle engine, so that the throttle valve is mechanically operated by the operated accelerator pedal 60 through the accelerator cable 72, in the present second embodiment. In the first embodiment, the throttle actuator for operating the throttle valve is controlled according to the output signal of the angular position sensor 64.

Figure 4B:
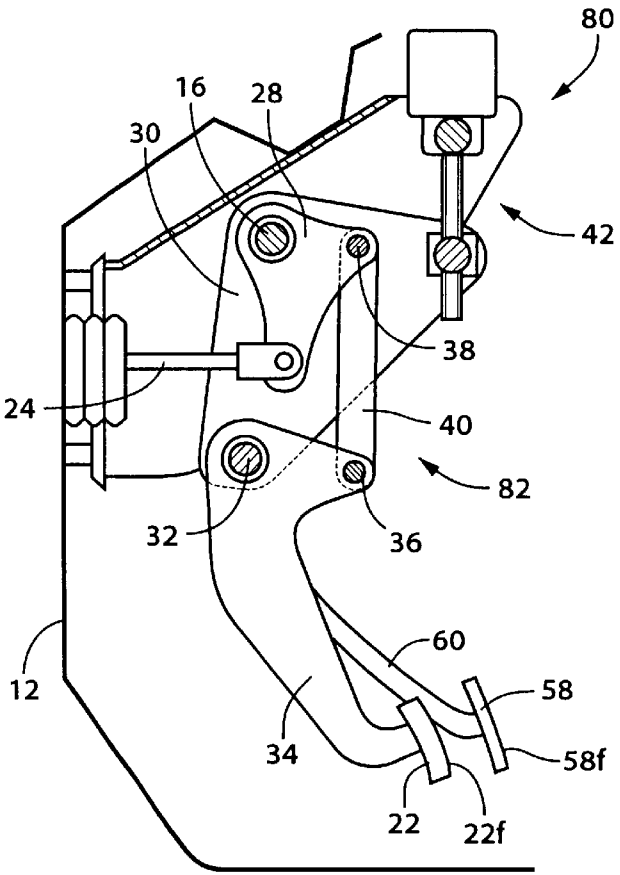
FIGS. 4A and 4B are views corresponding to those of FIGS. 1A and 1B, showing a third embodiment of this invention.
Figure 4A:
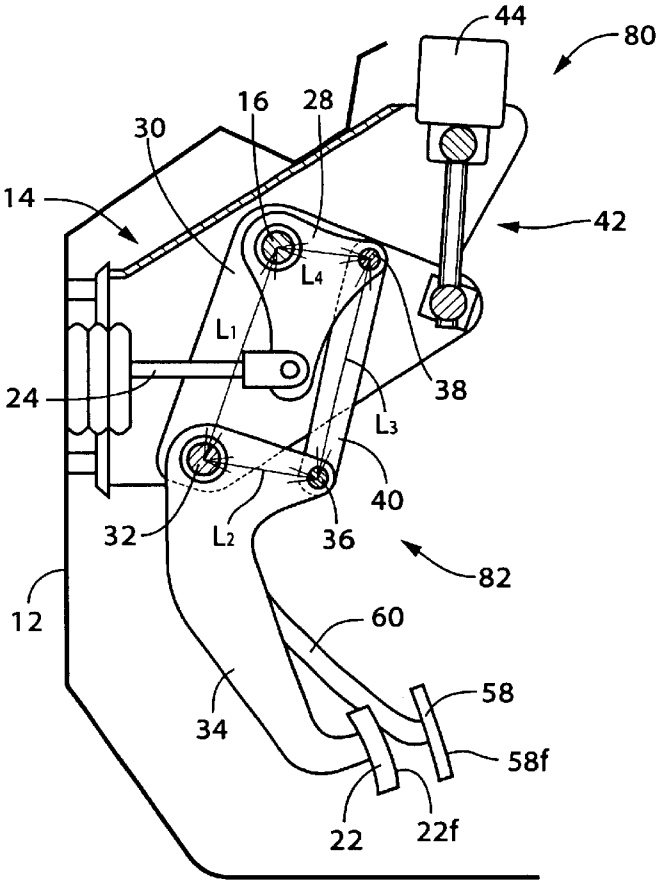

Referring to the elevational views of FIGS. 4A and 4B corresponding to those of FIGS. 1A and 1B, there is shown a vehicle pedal device assembly 80 constructed according to a third embodiment of the invention. This assembly 80 is different from the assembly 10 of the first embodiment, in the distances L1, L2, L3 and L4, and the range of adjustment of the position of the operating portions 22 and 58 of the pedals 34, 60 in the non-operated state in the longitudinal direction of the vehicle. The pedal device assembly 80 includes a brake pedal device 82 which is arranged to satisfy L1≧L3, and L2>L4, and to change the attitude of the brake pedal 34 such that an operating surface 22*f* of the operating portion 22 is gradually inclined upwards as the position of the operating portion 22 in the non-operated state of the brake pedal 34 is moved in the rearward direction from the fully advanced position of FIG. 4A to the fully retracted position of FIG. 4B. Further, the vertical position of the operating portion 22 is gradually lowered as the operating portion 22 of the brake pedal 34 in the non-operated state is moved toward the fully retracted position, as in the first embodiment. In the present arrangement, therefore, the operating portion 22 has the lowest vertical position at the fully retracted position at which the operating surface 22*f* faces most upwards. The vertical position of the operating portion 22 is gradually raised as the position of the operating portion 22 is moved toward the fully advanced position at which the operating surface 22*f* faces most sidewards, namely, in a direction closest to the horizontal plane. In other words, the angle of the operating surface 22*f* with respect to the vertical plane is the largest at the fully retracted position of FIG. 4B, and the smallest at the fully advanced position of FIG. 4A.

In the present pedal device assembly 80 of the present third embodiment, the position of the second connecting shaft 36 is different from that in the pedal device assemblies 10, 70 of the first and second embodiments, so that the relationship of L1–L4 in the third embodiment is different from that in the first and second embodiments. However, the pedal holding member 54 of the accelerator pedal device 20 is pivotally connected to the first connecting shaft 32, and the fourth and fifth connecting shafts 66, 68 are disposed to be substantially coaxial with the respective second and third connecting shafts 36, 38, in the non-operated state of the brake pedal 34, as in the preceding embodiments.

The pedal device assembly 80 according to the present third embodiment is arranged such that the operating surface 22*f* faces most upwards when the operating portion 22 is located at the fully retracted position nearest to the operator's seat, and such that the operating surface 22*f* is gradually inclined sidewards as the operating portion 22 is moved from the fully retracted position toward the fully advance position. Thus, the attitude of the operating portion 22 or the angle of inclination of the operating surface 22*f* with respect to the horizontal or vertical plane is suitably changed with a change in the position of the operating portion 22 in the longitudinal direction of the vehicle, so as to suit the physical characteristics of the vehicle operator, so that the brake pedal 34 can be easily manipulated by the operator. When the operating portion 22 of the brake pedal 34 in the non-operated state is located at the fully retracted position nearest to the operator's seat, the foot of the operator tends to approach the operating surface 22*f* in a relatively downward direction. In view of this tendency, the operating surface 22*f* is oriented d to face most upwards at the fully retracted position of the operating portion 22, and the operating surface 22*f* is gradually inclined sidewards as the position of the operating portion 22 is moved toward the fully advanced position. This arrangement permits relatively easy manipulation of the brake pedal 34 by any operator who is either tall or short.

In the present third embodiment, the operating portion 22 has the lowest vertical position when the operating portion 22 in the non-operated state is located at its fully retracted position, and the vertical position of the operating portion 22 is gradually raised as the operating portion 22 is moved toward the fully advanced position, as in the first and second embodiments. This change in the vertical position of the operating portion 22 in combination with the change in the attitude of the operating portion 22 (change in the angle of inclination of the operating surface 22*f*) significantly improves the ease of operation of the brake pedal 34 by any operators having different physical characteristics, irrespective of the non-operated position of the operating portion 22 in the longitudinal direction of the vehicle.

The vertical position and the attitude of the operating portion 58 of the accelerator pedal 60 are changed with the non-operated position of the operating portion 58, in the same manner as described above with respect to the brake pedal 34, so that the ease of operation of the accelerator pedal 60 is also significantly improved.

The L1–L4 may be determined such that L1<L3 while L2≧L4. In this case, too, the vertical position and the attitude of the operating portions 22, 58 can be changed as described above.

Referring to FIG. 5, there is shown a pedal device assembly 90 according to a fourth embodiment of the present invention, which is different from the pedal device assembly 10 in the structure for pivotally supporting the pedal holding member 54 of a accelerator pedal device 92. Described more specifically, the adjusting link 30 has a mounting shaft 94 parallel to the support shaft 16, as well as the first connecting shaft 32, and the pedal holding member 54 is pivotally connected to this mounting shaft 94, rather than to the first connecting shaft 30. In the present fourth embodiment, the support shaft 26, the mounting shaft 94 and the fourth and fifth connecting shafts 66, 68 are radially positioned relative to each other so as to satisfy the following equations (3) and (4):

$$L11=L13 \quad (3)$$

$$L12=L14 \quad (4)$$

In the above equations (3) and (4), L1–L4 represent the following distances:

L11=distance between the axes of the support shaft 16 and the mounting shaft 94

L12=distance between the mounting shaft 94 and the fourth connecting shaft 66

L13=distance between the fourth and fifth connecting shafts 66, 68

L14=distance between the fifth connecting shaft 68 and the support shaft 16

The positioning of the shafts 16, 94, 66, 68 as described above permits the accelerator pedal 60 to be translated along a circular arc in the longitudinal direction of the vehicle, without a change in the attitude of the operating portion 58, in the same manner as the brake pedal 34 when the adjusting link 30 is pivoted about the support shaft 16 by the adjusting mechanism 42.

In the pedal device assembly 90, too, a pivotal motion of the adjusting link 30 by the adjusting mechanism 42 permits concurrent translating movements of the brake pedal 34 and the accelerator pedal 60 in the longitudinal direction of the vehicle. In this respect, the assembly 90 has the same advantages as the assembly 10. However, the position of the axis of the mounting shaft 94 is different from that of the first connecting shaft 32, the vertical positions of the operating portions 22, 58 of the pedals 34, 60 are changed in different manners as the operating portions 22, 58 are adjusted in the longitudinal direction of the vehicle.

The attitude of the operating portion 58 of the accelerator pedal 60 in the pedal device assembly 90 may be changed in the same manner as that in the pedal device assembly 80 of FIGS. 4A and 4B, if the support shaft 16, mounting shaft 94 and fourth and fifth connecting shafts 66, 68 are positioned relative to each other so as to satisfy either $L11 \geqq L13$, and $L12 > L14$, or $L11 < L13$, and $L12 \geqq L14$.

The pedal device assembly 80 of FIGS. 4A and 4B may be modified such that the pedal holding member 54 is pivotally connected to a mounting shaft provided on the adjusting link 30, rather than to the first connecting shaft 32.

While the presently preferred embodiments of this invention have been described above by reference to the drawings, for illustrative purpose only, it is to be understood that the present invention may be embodied with various changes, modifications and improvements, which may occur to those skilled in the art, without departing from the spirit and scope of the invention defined in the following claims:

What is claimed is:

1. A pedal device assembly for a vehicle, comprising:

a stationary bracket fixed to a body of the vehicle and having a support shaft and an adjusting shaft;

a pivotal arm disposed pivotally about said support shaft, to provide an output in the form of a pivotal motion thereof about said support shaft;

an adjusting mechanism;

an adjusting link connected pivotally to said adjusting shaft, and pivotable by said adjusting mechanism so that said adjusting link is positioned to a predetermined angular position;

a manually operable first pedal connected to said adjusting link pivotally relative to said adjusting link about a first connecting shaft parallel to said support shaft, said first pedal having an operating portion at which said first pedal is operated by an operator of the vehicle, for a pivotal motion thereof about said first connecting shaft;

a drive link connecting said first pedal and said pivotal arm such that said drive link is pivotable about a second connecting shaft and a third connecting shaft which are disposed parallel to said support shaft, at respective positions which cooperate with positions of said adjusting shaft and said first connecting shaft to define a rectangle, said drive link cooperating with said adjusting link to position said first pedal with a predetermined attitude, and being operable to pivot said pivotal about said support shaft when said first pedal is pivoted about said first connecting shaft upon operation of said first pedal at said operating portion;

said adjusting mechanism being operable to effect a pivotal motion of said adjusting link about said adjusting shaft, for thereby causing an arcuate motion of said first pedal in a longitudinal direction of the vehicle together with a pivotal motion of said drive link about said third connecting shaft, so that a position of said operating portion in a non-operated state of said first pedal is moved in said longitudinal direction;

a pedal holding member pivotally supporting a second pedal and disposed pivotally about a mounting shaft provided on said adjusting link in parallel with said support shaft, said second pedal having an operating portion; and a connecting link connecting said pedal holding member and a stationary member fixed to said body of the vehicle, to position said pedal holding member with a predetermined attitude, said connecting link being pivotable about a fourth connecting shaft and a fifth connecting shaft which are disposed parallel to said support shaft, at respective positions which cooperate with the positions of said adjusting shaft and said mounting shaft to define a rectangle, said connecting link, and wherein said connecting link is pivoted about said fifth connecting shaft upon said pivotal motion of said adjusting link by said adjusting mechanism, and cooperates with said adjusting link to cause an arcuate motion of said pedal holding member in said longitudinal direction, so that a position of said operating portion of said second pedal in a non-operated state of said second pedal is moved in said longitudinal direction.

2. A pedal device assembly according to claim 1, wherein said first pedal is a brake pedal for operating an ordinary braking system of the vehicle, and said second pedal is an accelerator pedal for controlling a throttle valve of an engine of the vehicle.

3. A pedal device assembly according to claim 1, wherein said support shaft also serves as said adjusting shaft, and said first connecting shaft also serves as said mounting shaft.

4. A pedal device assembly according to claim 3, wherein said fourth and fifth connecting shafts are disposed substantially coaxially with said second and third connecting shafts, respectively, when said first pedal is in said non-operated state.

5. A pedal device assembly according to claim 1, wherein said adjusting mechanism is operable to move the position of said operating portion of said first pedal in said non-operated state in said longitudinal direction such that said operating portion has a lowest vertical position when said operating portion is, located at a fully retracted position nearest to a seat of said operator, and such that a vertical position of said operating portion is raised as the position of said operating portion is moved from said fully retracted position toward a fully advanced position in said longitudinal direction.

6. A pedal device assembly according to claim 1, wherein axes of said first and second connecting shafts are located below those of said adjusting shaft and said third connecting shaft, while the axes of said second and third connecting shafts are located rearwardly of those of said first connecting shaft and said adjusting shaft in said longitudinal direction, and wherein said adjusting shaft and said first, second and third connecting shafts are radially positioned relative to each other, so as to satisfy $L1 \geqq L3$, and $L2 > L4$, or satisfy $L1 < L3$, and $L2 \geqq L4$, wherein said L1, L2, L3 and L4 respectively represent a distance between the axes of said adjusting shaft and said first connecting shaft, a distance between the axes of said first and second connecting shafts, a distance between the axes of said second and third connecting shafts, and a distance between the axes of said third connecting shaft and said adjusting shaft.

7. A pedal device assembly according to claim 1, wherein axes of said first and second connecting shafts are located below those of said adjusting shaft and said third connecting shaft, while the axes of said second and third connecting shafts are located rearwardly of those of said first connecting shaft and said adjusting shaft in said longitudinal direction, and wherein said adjusting shaft and said first, second and third connecting shafts are radially positioned relative to each other, so as to satisfy L1=L3, and L2=L4, wherein said L1, L2, L3 and L4 respectively represent a distance between the axes of said adjusting shaft and said first connecting shaft, a distance between the axes of said first and second connecting shafts, a distance between the axes of said second and third connecting shafts, and a distance between the axes of said third connecting shaft and said adjusting shaft.

* * * * *